US005997957A

United States Patent [19]

Bertamini et al.

[11] Patent Number: 5,997,957

[45] Date of Patent: Dec. 7, 1999

[54] PROCESS FOR DEPOSITION OF LAYERED COATINGS ON COPPER AND ALLOYS THEREOF

[75] Inventors: Luca Bertamini; Edoardo Severini; Mario Tului, all of Rome, Italy

[73] Assignee: Centro Sviluppo Materiali S.p.A., Rome, Italy

[21] Appl. No.: 09/114,916

[22] Filed: Jul. 14, 1998

[30] Foreign Application Priority Data

Jul. 16, 1997 [IT] Italy ..... RM97A0437

[51] Int. Cl.[6] ..... C23C 4/04; C23C 4/02

[52] U.S. Cl. ..... 427/450; 427/452; 427/454; 427/455; 427/456

[58] Field of Search ..... 427/450, 454, 427/455, 456, 452

[56] References Cited

U.S. PATENT DOCUMENTS 4,095,005 6/1978 Kishida et al. ..... 427/454

4,576,874 3/1986 Spengler et al. ..... 427/454

*Primary Examiner*—Katherine A. Bareford

*Attorney, Agent, or Firm*—Browdy and Neimark

[57] ABSTRACT

A process for the deposition of thick coatings with a thickness >1 mm on products made of copper or alloys thereof, wherein said products are subjected to the following operations: surface activation of the product made of copper or alloys thereof; optional heat stabilization to a temperature below the ones causing deterioration of the chemical and physical properties of the copper or alloys thereof; deposition of a first layer, for example of Ni or alloys thereof; optional interdiffusion heat treatment; optional activation of the surface of the first layer; thermal stabilization of said product at a temperature of between 20° and 400° C.; deposition of one or more intermediate layers of at least one of the following: Al; AlSi; Cu; Ni; NiAl; NiCr; NiCu; MCrAlY (wherein M can be Ni, Co, Fe or mixtures thereof), mixtures thereof, or mixtures of said intermediate layers with said thick coating; thermal stabilization of the product coated with said intermediate layers at a temperature of between 20° and 300° C.; and deposition of said thick coating on the product coated with said intermediate layers.

20 Claims, 2 Drawing Sheets

PROCESS FOR DEPOSITION OF LAYERED COATINGS ON COPPER AND ALLOYS THEREOF

DESCRIPTION

The present invention relates to a process for the deposition of a coating, capable of excellent adhesion, having a thickness greater than the ones obtained in the art, and a good level of resistance to thermal cycles, on metal components made of copper or alloys thereof.

BACKGROUND OF THE INVENTION

The present invention can be applied to all those cases where the presence of closely adhering coatings on copper substrates is required, such as applications on components subjected to thermal cycles, for example in the fields of power generation and in foundries.

An example of a possible application are those components that, in nuclear reactors, face onto the plasma. In these cases the presence of a coating is necessary to provide resistance against heat and erosion by ion bombardment. In nuclear plants, many components (for example the divertor), which are made for example of copper to guarantee effective heat exchange levels, are subjected to the erosive action of particles and ions from the plasma, as well as being subjected to the high temperatures resulting from the presence of plasma. As a result of this, their average lifespan is reduced to unacceptable levels, and problems also arise in relation to pollution of the plasma and of the atmosphere in the reactor itself by the particles and compounds that evaporate, sublimate or are removed by sputtering. Furthermore, the presence on the surfaces of metals such as cobalt or nickel results in the formation of radioactive isotopes, with the consequent danger of pollution and damage to human health.

The materials currently considered most suitable to protecting the surfaces of said components against erosion are the following: tungsten and boron carbide (materials with a high and a low atomic number, respectively). In particular, tungsten is considered to be the most interesting material. However, application of tungsten is not easy, as this material is solid up to 3750 K and characterised by a thermal expansion coefficient that differs considerably with respect to that of copper.

The methods used to apply a protective coating of said material are currently those of welding or brazing of solid tungsten tiles and plasma-spray coating. However, each of these methods involve problems that make it difficult to obtain reliable coatings, in particular for applications that foresee thermal stress during service, due for example to the thermal cycles induced by the operations for start-up and shut-down of the plant.

Brazing and electron-beam welding make it possible to apply solid tungsten tiles, even tens of millimetres in thickness, on the components to be protected. However, the use of this method involves the following problems:

- the difficulty in producing tungsten tiles of complex shapes, capable of providing an exact reproduction of complex curved surfaces;
- the difficulty in welding/brazing on surfaces with a complex shape;
- the difficulty in welding/brazing on very large surfaces;
- the action into the component of stresses induced by the welding temperature, due to the different expansion coefficients in the substrate and in the tungsten and to the high temperatures required to join the two elements.

Mechanical application of plates, locked for example using screws, does not appear to be practicable, due to the imperfect adherence between the plate and the substrate, which results in a drastic reduction in the thermal conductivity of the whole component.

On the contrary, thermal spraying makes it possible to coat even objects with a complex geometry. It has the advantage of allowing local repairs to be carried out. However, at the present time the use of thermal spraying is limited by the following problems:

- stresses induced by the deposition temperature due among other things to the high levels of power required to melt the particles of tungsten;
- low adhesion of the coating, in the specific case of copper alloy components, due to the speed with which a layer of copper oxide, which is fragile and difficult to remove, is formed on the surface of the copper in the presence of oxygen in the atmosphere.

The problem of low adhesion appears to be the most critical for function of the coating, and the most important to solve, as the reliability of the component when in service depends upon it, in particular during operations for start-up or shut-down of the plant.

This problem is emphasized by the presence of thermo-mechanical stresses induced in the coating at every change in temperature, due to the considerable difference in thermal expansion coefficients (close to $20\times10^{-6}$ $K^{-1}$ for copper; approximately $4\times10^{-6}$ $K^{-1}$ for tungsten), this stress being concentrated in particular in the copper/tungsten interface area.

The difference in expansion coefficients is also the cause of creation within the coating of so-called residual deposition stress (see for example, T. W. Clyne, S. C. Gill: "Residual stress in thermal spray coatings and their effect on interfacial adhesion."—Journal of Thermal Spray Technology, March 1995). This stress, when added to the stress generated by the temperature variations to which the component is subjected during function, result in a considerable decrease in the adhesion of the coating itself. Limitation of the maximum thickness obtainable with plasma-deposit coatings is mainly due to the phenomenon described above (see, for example, T. Shinoda et al.: "Development of dry process for heavy thickness coating layer"—Acts of the International Thermal Spray Conference '95, Kobe, J, which indicates a maximum thickness obtainable with plasma-deposit coatings of around one millimeter).

In order to obtain thick and reliable coatings, it is therefore necessary to solve the problem of adhesion of the coating itself to the copper substrate, and of distribution of residual stress to the tungsten-copper interface.

From the above considerations, it can be seen that, at the present state of the art, it is practically impossible to obtain thick and reliable coatings on copper and alloys thereof using thermal spraying technology. The statement made above for the specific case of thick tungsten coatings is also true in general, and the more so the more the thermal expansion coefficients of the component and coating materials differ.

SUMMARY OF THE INVENTION

The object of the present invention is to provide not only a process for the production of thick coatings on components made of copper or alloys thereof, having a good resistance to thermal cycles, but also the components coated and obtained thereby.

Therefore, subject of the present invention is a process for the deposition of thick coatings with a thickness >1 mm on copper products or alloys thereof, in which said products are subjected to the following operations:

surface activation of the copper product or alloys thereof;

optional heat stabilisation to a temperature below the temperature causing deterioration of the chemical and physical properties of the copper or alloys thereof;

deposition of a first layer, for example of Ni or alloys thereof;

optional interdiffusion heat treatment;

optional surface activation of the first layer;

thermal stabilisation of said product at a temperature of between 20° and 400° C.;

deposition of one or more intermediate layers of at least one of the following: Al; AlSi; Cu; Ni; NiAl; NiCr; NiCu; MCrAlY (wherein M can be Ni, Co, Fe or mixtures thereof), mixtures thereof, or mixtures of said intermediate layers and said thick coating;

thermal stabilisation of the product coated with said intermediate layers at a temperature of between 20° and 300° C.; and deposition of said thick coating on the product coated with said intermediate layers.

In the process according to the invention, in the case of a metallic coating, said coating is selected from Cr, Ni, Mo, Ta, W or alloys thereof, whereas if the coating is a ceramic coating, it is selected from $Al_2O_3$, $B_4C$, $Cr_3C_2$, $CrO_2$, TiC, $TiO_2$, WC, $ZrO_2$ or mixtures thereof.

Thermal spray deposition of the first layer of Ni or alloys thereof and/or of the intermediate layers of Ni or alloys thereof can be carried out, for example, using a plasma torch in a protected atmosphere, for example Ar, at a pressure comprised between $4\times10^3$ and $4\times10^5$ Pa, generating between the torch and the surface of the component an electric arc and imposing negative polarity on the component itself, and with an arc current comprised between 5 and 40 A, or for example using high-speed thermal spraying techniques (such as HVOF).

Alternatively, the first layer of Ni can be deposited by galvanisation or using chemical methods.

A further subject of the present invention is the coated component so obtainable using the process described above.

BRIEF DESCRIPTION OF THE DRAWINGS

The invention will be further illustrated in the description of preferred embodiments thereof, given merely as non-limiting examples, with reference to the enclosed drawings, in which.

DETAILED DESCRIPTION OF THE INVENTION

Figure 1:
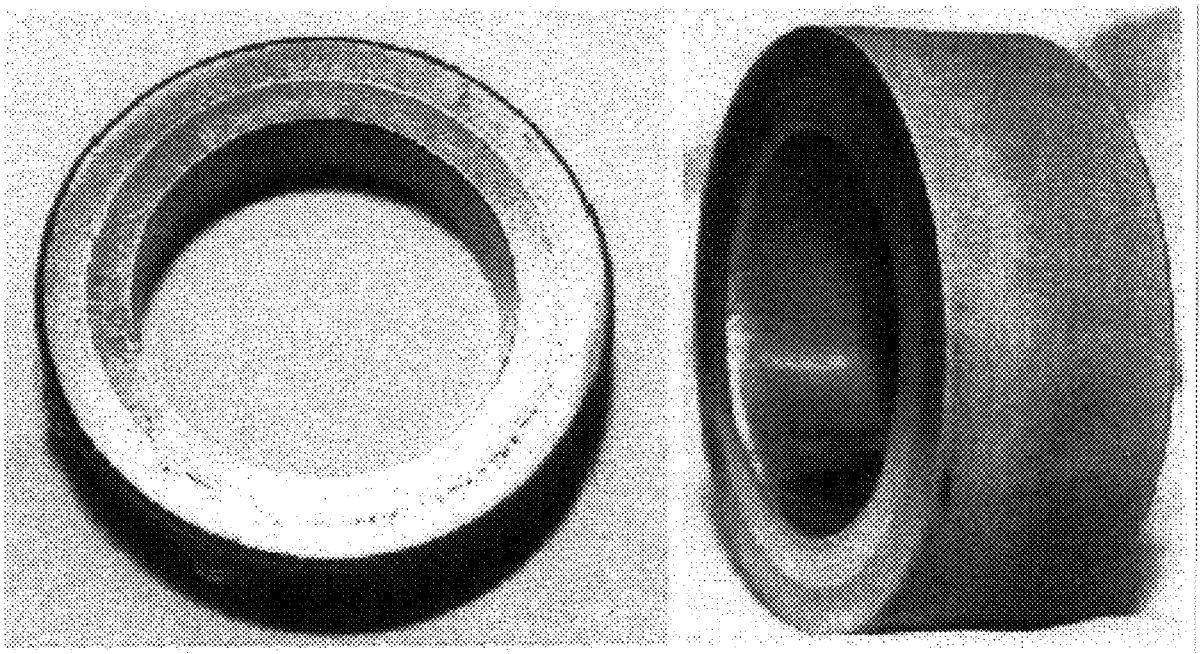
FIG. 1 shows a photograph of the component obtained using the process described in the present invention.

Application of the process described in the present invention differs according to whether the component made of copper or alloys thereof is coated with Ni or alloys thereof by thermal spraying or by galvanisation or chemical processes.

In the former case, Ni or alloys thereof are applied to the component made of copper of alloys thereof by means of thermal spraying, and activation takes place in three phases.

The first phase consist in cleaning the surface to be coated, to remove any dirt that may be present, by means of chemical etching. The second phase is the optional roughening of said surface by sanding; the object of sanding may be, for example, to remove surface layers of oxide and to improve the mechanical adhesion of the layer to be applied subsequently. The third phase is surface cleaning of the component to be coated, in particular to remove surface layers of oxide and other compounds, by applying, in an inert gas atmosphere (for example under Argon), an electric arc between the deposition torch and said component, with negative polarity connected to the component.

Thermal stabilisation is then performed by heating the component until reaching temperatures lower than those at which any deterioration of the chemical and physical properties of the copper or alloys thereof takes place.

The component is then coated, using the method of plasma spraying in an inert atmosphere (e.g. Argon), with a first thin layer of a suitable material, for example nickel or alloys thereof, capable of a good adhesion to the substrate, optionally also by means of chemical interaction, both by creating interdiffusion layers and layers of chemical compounds. During deposition the temperature must be kept below the annealing temperatures of the copper alloy, or temperatures that might cause irreversible deterioration of the mechanical properties of the alloy. Furthermore, during deposition of said material an electric arc may be applied between the torch and the substrate.

Said arc has the object of improving cleaning of the surface close to the area in which the particles will impact, and of causing local overheating, for limited periods of time, to facilitate chemical interaction of the material transferred to the substrate.

As an alternative to the plasma spraying method in an inert atmosphere, it is also possible to use the method of high speed spraying (HVOF) of a first layer of a suitable material.

In this second case, Ni or an alloy thereof is applied to the component in copper or alloys thereof by means of galvanisation or using a chemical process.

When preparation of the first layer has been completed, may be required a suitable thermal post-treatment, with the aim of encouraging chemical interaction between the first layer and the substrate, in order to increase adhesion between the coating and the component.

Therefore, a cleaning treatment may be required every time the component comes into contact with air or is made dirty by dust, to remove oxides and other surface compounds from the component coating with the first layer. Said treatment is carried out by application, in an inert gas atmosphere (for example Argon) of an electric arc between the deposition torch and the substrate to be coated, with the negative polarity being connected to the piece to be coated.

Thermal stabilisation is then carried out by heating the component until it reaches the chosen deposition temperature, which in any case must be below the annealing temperature for the copper alloy, or the temperature at which irreversible deterioration of the mechanical properties of the alloy might occur.

Using the thermal spraying method, for example plasma spraying, optionally in an inert atmosphere (e.g. Argon) or at high speed, one or more intermediate layers are deposited, made up of materials, or mixtures thereof, that are selected in such a way as to provide a thermal expansion coefficient comprised between that of the substrate to that of the coating to be deposited.

Thermal stabilisation is then performed again, until reaching the chosen deposition temperature.

Finally, the thick coating is obtained on components made of copper or alloys thereof, by plasma spray deposition, optionally in an inert atmosphere (e.g. Argon) or at high speed, with suitable plasma parameters to provide adequate fusion of the powdered raw materials, of successive layers of material, keeping the deposition temperature under control by means of suitable cooling of the piece during deposition.

Up to this point, a general description has been given of the present invention. With the aid of the following examples, a detailed description of embodiments thereof will now be given, with the aim of giving a clearer understanding of the aims, characteristics, advantages and operating methods thereof.

EXAMPLE 1

In this example, a pipe of copper-chrome-zirconium alloy, with a diameter of 50 mm and a length of 200 mm, was sanded on its outer surface, cleaned using the action of a jet of compressed gas to remove any residual sand, and then fitted onto a movement device inside a chamber within which the process of the present invention was carried out.

The depression chamber was evacuated until reaching a vacuum level of 1 Pa and then filled with Ar until reaching a pressure of $3{,}5\times10^4$ Pa. The plasma torch was then lit, using Ar as the plasma gas, and regulating to a power level of 35 kW by insertion of a flow rate of 2 l/min $H_2$. Between the torch and the surface of the sample an electric arc was created, the negative pole being the sample itself; the current transported by the arc was 20 A. The torch, set at a distance of 110 mm from the substrate, was moved in a frontal manner along the axis of the piece to be coated, at a speed, with respect to the sample, of 400 mm/s, whereas the sample was made to rotate around its own axis at a speed of 150 rpm. Scanning by the torch, the width of which was such as to involve the whole surface of the piece, was repeated at least 10 times, and in any case until the disappearance of the layer of surface oxides was noted. During said surface cleaning phase, the temperature was between 50 and 250° C.

The chamber was then brought up to a pressure of $8\times10^4$ Pa Ar and the component was heated until it stabilised at a temperature of 350° C., which is below to the temperature causing deterioration of the mechanical properties by annealing, being equivalent to 450° C.

The surface of the component was coated with a layer, 80 $\mu$m thick, of Ni-20%Al, using the plasma heat spraying method, making use of the following parameters: torch power 35 kW, spraying distance 125 mm, scanning speed 400 mm/s, rotation speed of the sample around its own axis 150 rpm. During deposition, an electric arc was formed between the torch and the surface of the sample, the negative pole being the sample itself; the current transported by the arc was equivalent to 15 A. During said deposition phase, the temperature was between 280 and 350° C.

In this specific case, since the material in the component was heat treated in advance in order to obtain special mechanical properties, the interdiffusion heat treatment was not carried out.

Activation of the surface was not carried out, as deposition of the intermediate layers, described below, was performed in the same deposition chamber in which deposition of the priming layer was carried out, without removing the sample and without changing the atmosphere. The component thus remains in an inert atmosphere and the surface has no opportunity of becoming contaminated.

The component was heated again until its stabilisation at a temperature of 250° C.

On the surface coated in this manner, nineteen intermediate layers were deposited by means of thermal spraying, each layer having a thickness of approximately 20 $\mu$m to give a total thickness of 380 $\mu$m. Each layer was obtained by means of four successive passages of the torch. Said layers were obtained by mixing the following powders: Ni-20%Al, Al-12%Si and W, as shown in the chart given in table 1, in which numbering of the layers is according to the order in which said layers were deposited. In table 2 the process parameters used for deposition of said layers are given. During deposition, an electric arc was created between the torch and the surface of the sample, the negative pole being the sample itself; the arc current was equivalent to 15 A.

The component was stabilised at a temperature of 150° C.

On the surface coated as above, 1100 layers of tungsten were deposited using the plasma heat spraying method, each layer approximately 5 $\mu$m thick, giving a total of 5.5 mm. Said layers were deposited using the following parameters: torch power 40 kW, spraying distance 180 mm, scanning speed 800 mm/s, speed at which the piece rotates around its own axis 300 rpm. The temperature of the component was maintained within the interval of 50 and 180° C.

After spraying, the surface of the tungsten was cooled using a jet of compressed Argon, to prevent the copper substrate from cooling first, which might induce excessive stress in the copper/coating substrate. After cooling and in any case only after the temperature had dropped to below 50° C. the chamber was opened and the piece extracted.

The total thickness of the coating (total being intended to refer to the sum of the thickness of the priming layer, the intermediate layers and the coating), measured using a 3D mechanical thickness tracer, was: 6.05±0.15 mm.

Figure 2:
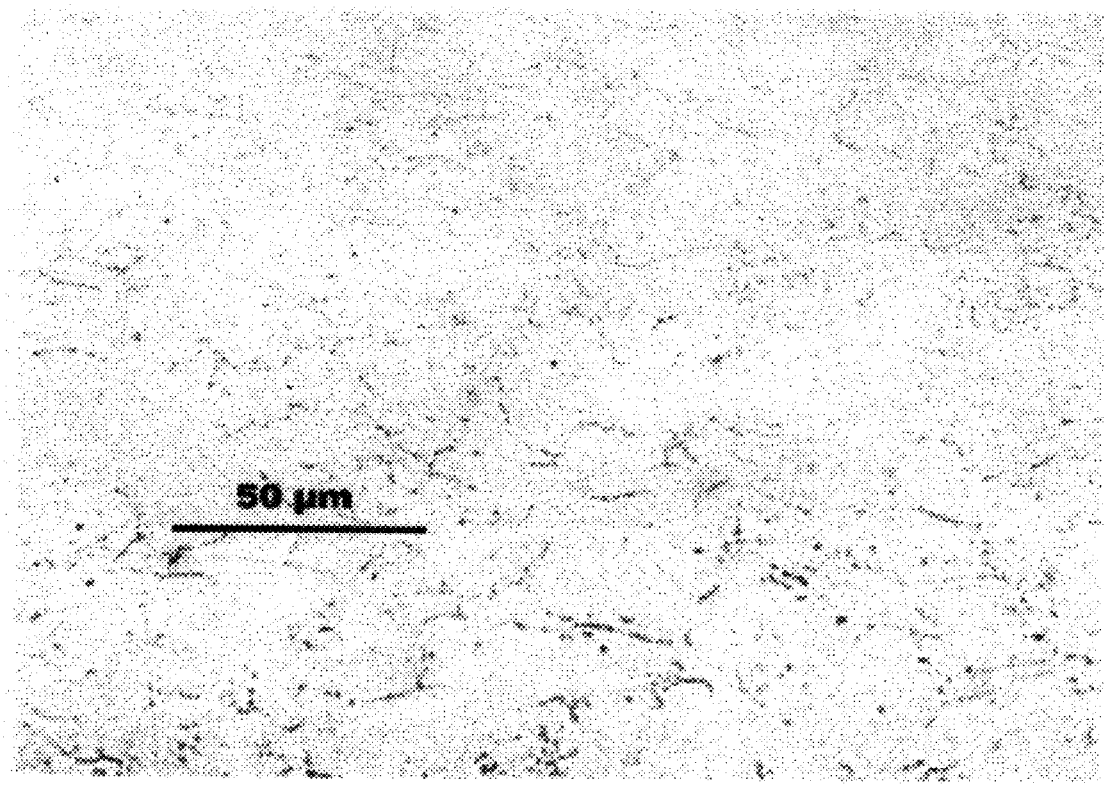
FIG. 2 shows an optical microscope micrography of a cross section of said component.

FIG. 1 shows a photograph of the component obtained using the procedure described in the present example, and FIG. 2 shows an optical microscope micrography of the section of said component.

The results of characterisation of the tungsten coating microstructure gave the following values:

modulus: 64 GPa density: 17.4 g/cm$^3$ non-melted particle content: <5% absence of vertical cracks and/or cracks parallel to the interface good level of homogeneity throughout the thickness Thermal cycling tests were carried out on this sample, heating the piece with an electronic gun, while water was made to flow through the inside for cooling. The sample showed no cracks after the following cycles had been performed:

1)1000 cycles with a surface temperature of 820° C.

2)200 cycles with a surface temperature of 1200° C.

EXAMPLE 2

In this second example, a pipe with dimensions identical to those of the component described in the preceding example was subjected to a process that coincides with the one described in the preceding example up to the point at which deposition of the intermediate layers takes place.

The deposition chamber was then brought up to a pressure of $1.4\times10^5$ Pa of argon and the component was heated until it stabilised at a temperature of 150° C.

On the surface coated with the intermediate layers, 600 layers of tungsten are deposited by thermal plasma spraying, each layer with a thickness of approximately 5 $\mu$m, giving a total of 3.0 mm. Said layers have been deposited with the following parameters: torch power 45 kW, spraying distance 170 mm, scanning speed 800 mm/s, speed of rotation of the piece around its own axis 300 rpm. The temperature of the component was maintained within the interval of between 50 and 180° C.

After spraying, the surface of the tungsten was cooled with a jet of compressed Argon to prevent the copper substrate from cooling first, which might induce excessive stress in the copper-coating interface. After cooling, and in any case only after the temperature has dropped below 50° C., the chamber is opened up and the piece extracted.

The total thickness of the coating (the total being intended as the sum of the thickness of the priming layer, the intermediate layers and the coating), measured using a 3D mechanical thickness tracer, was: 3.55±0.15 mm.

The same characterisation operations performed on the sample described in example 1 were carried out on this component, with the same results.

The following are two tables illustrating the process parameters used in example 1 described above, according to the process of the present invention.

TABLE 1

| Layer number | AlSi (%) | NiAl (%) | W (%) |
|---|---|---|---|
| 1 | 50 | 50 | 0 |
| 2 | 40 | 60 | 0 |
| 3 | 30 | 70 | 0 |
| 4 | 30 | 70 | 0 |
| 5 | 20 | 80 | 0 |
| 6 | 20 | 80 | 0 |
| 7 | 10 | 90 | 0 |
| 8 | 10 | 90 | 0 |
| 9 | 0 | 100 | 0 |
| 10 | 0 | 90 | 10 |
| 11 | 0 | 80 | 20 |
| 12 | 0 | 70 | 30 |
| 13 | 0 | 60 | 40 |
| 14 | 0 | 50 | 50 |
| 15 | 0 | 40 | 60 |
| 16 | 0 | 30 | 70 |
| 17 | 0 | 20 | 80 |
| 18 | 0 | 10 | 90 |
| 19 | 0 | 0 | 100 |

TABLE 2

| Layer number | Torch power (kW) | Spraying distance (mm) | Deposition temperature (° C.) |
|---|---|---|---|
| 1 | 32 | 130 | 270–350 |
| 2 | " | " | 350–330 |
| 3 | " | " | 230–290 |
| 4 | " | " | 210–280 |
| 5 | " | " | 200–280 |
| 6 | " | " | 180–240 |
| 7 | " | " | 160–180 |
| 8 | " | " | 140–200 |
| 9 | " | " | 120–130 |
| 10 | " | 170 | 100–180 |
| 11 | 33 | " | 90–110 |
| 12 | 34 | " | 90–110 |
| 13 | 35 | " | 90–110 |
| 14 | 36 | " | 90–110 |
| 15 | 37 | " | 90–110 |
| 16 | 38 | " | 90–110 |
| 17 | 39 | " | 90–110 |

TABLE 2-continued

| Layer number | Torch power (kW) | Spraying distance (mm) | Deposition temperature (° C.) |
|---|---|---|---|
| 18 | 40 | " | 90–110 |
| 19 | 40 | " | 90–110 |

We claim:

1. A process for the deposition of thick coatings having a thickness >1 mm onto products of copper and alloys thereof, in which process said products are subjected to the following operations:

surface activation of the copper product or alloys thereof;

optional heat stabilisation to a temperature below the temperature causing deterioration of chemical and physical properties of the copper or alloys thereof;

deposition of a first layer onto the copper or alloys thereof;

optional interdiffusion heat treatment of the copper or alloys thereof with the first layer applied;

optional activation of the surface of the first layer;

thermal stabilisation of said coated product at a temperature of between 20° and 400° C.;

deposition of one or more intermediate layers of at least one material selected from the group consisting of: Al; AlSi; Cu; Ni; NiAl; NiCr; NiCu; MCrAlY (wherein M can be Ni, Co, Fe or mixtures thereof); mixtures thereof; and mixtures of said intermediate layers and said thick coating onto the first layer by thermal spraying;

thermal stabilisation of the product coated with said first layer and said one or more intermediate layers at a temperature of between 20° and 300° C.; and deposition of said thick coating onto the product coated with said first layer and said one or more intermediate layers by thermal spraying.

2. A process according to claim 1, in which said operation for deposition of said thick coating on the coated product takes place by means of thermal spraying in an inert atmosphere and at a temperature of between 20° and 300° C.

3. A process according to claim 2, in which said thick coating is a metal or metal alloy and is selected from the group consisting of: Cr, Ni, Mo, Ta, W or alloys thereof.

4. A process according to claim 2, in which said thick coating is a ceramic and is selected from the following: $Al_2O_3$, $B_4C$, $Cr_3C_2$, $CrO_2$, TiC, $TiO_2$, WC, $ZrO_2$ or mixtures thereof.

5. A process according to claim 2, in which said surface activation operation takes place by means of at least one of the pre-treatments selected from the group consisting of:

sanding;

sputtering;

chemical pickling; and combinations thereof.

6. A process according to claim 2, in which the deposition of said first layer takes place by means of:

thermal spraying.

7. A process according to claim 6, in which the thermal spraying of the first layer or the one or more intermediate layers takes place using a plasma or high speed torch.

8. A process according to claim 7, in which said deposition uses a plasma torch and takes place in a protected atmosphere, and at a temperature of between 20 and 400° C.

9. A process according to claim 8, in which said protected atmosphere is at a pressure between $4\times10^3$ and $4\times10^5$ Pa.

10. A process according to claim 9, in which an electric arc with negative polarity in the product itself is generated between the torch and the surface of the product.

11. A process according to claim 10, in which the value of the current transported by the electrical arc is between 5 and 40 A.

12. A process according to claim 1, in which said thick coating is a metal or a metal alloy and is selected from the group consisting of: Cr, Ni, Mo, Ta, W or alloys thereof.

13. A process according to claim 1, in which said thick coating is a ceramic and is selected from the following: $Al_2O_3$, $B_4C$, $Cr_3C_2$, $CrO_2$, TiC, $TiO_2$, WC, $ZrO_2$ or mixtures thereof.

14. A process according to claim 1, in which said surface activation operation takes place by means of at least one of the pre-treatments selected from the group consisting of:

sanding;

sputtering;

chemical picking; and combinations thereof.

15. A process according to claim 1, in which the deposition of said first layer takes place by means of at least one of the treatments selected from the group consisting of:

thermal spraying treatment;

chemical treatment; and galvanisation treatment.

16. A process according to claim 15, in which the thermal spraying of the first layer or the one or more intermediate layers takes place using a plasma or high speed torch.

17. A process according to claim 16, in which said deposition uses a plasma torch and takes place in a protected atmosphere, and at a temperature of between 20 and 400° C.

18. A process according to claim 17, in which said protected atmosphere is at a pressure between $4\times10^3$ and $4\times10^5$ Pa.

19. A process according to claim 18, in which an electric arc with negative polarity in the product itself is generated between the torch and the surface of the product.

20. A process according to claim 19, in which the value of the current transported by the electrical arc is between 5 and 40 A.

* * * * *